US006619218B2

(12) United States Patent
Tsuruta

(10) Patent No.: US 6,619,218 B2
(45) Date of Patent: Sep. 16, 2003

(54) METHOD AND APPARATUS FOR MAKING A POLLUTANT HARMLESS

(75) Inventor: Hisao Tsuruta, Tokyo (JP)

(73) Assignees: San Iku Co., Ltd., Tokyo (JP); International Preserve Environment Co., Ltd., Tokyo (JP)

( * ) Notice: Subject to any disclaimer, the term of this patent is extended or adjusted under 35 U.S.C. 154(b) by 136 days.

(21) Appl. No.: 09/840,094

(22) Filed: Apr. 24, 2001

(65) Prior Publication Data

US 2002/0068846 A1 Jun. 6, 2002

(30) Foreign Application Priority Data

Dec. 5, 2000 (JP) ..... 2000-370351

(51) Int. Cl.[7] ..... F23G 7/00; A62D 3/00

(52) U.S. Cl. ..... 110/346; 110/342; 110/266; 588/205; 588/900

(58) Field of Search ..... 110/203, 206, 110/207, 215, 233, 266, 342, 345, 346, 260, 261, 262, 263, 264, 265; 241/39, 5; 888/234; 588/205, 206, 207, 208, 248, 900; 431/189, 354, 186, 175, 176

(56) References Cited

U.S. PATENT DOCUMENTS 3,277,945 A * 10/1966 Vermes ..... 158/5
3,426,734 A * 2/1969 Rickard et al. ..... 122/478
3,748,081 A * 7/1973 Hummell ..... 431/7
4,431,612 A * 2/1984 Bell et al. ..... 422/186.21
4,508,040 A * 4/1985 Santen et al. ..... 4/198
4,635,568 A * 1/1987 Angelo, II ..... 110/214
5,123,836 A * 6/1992 Yoneda et al. ..... 431/5
5,187,344 A * 2/1993 Mizuno et al. ..... 219/121.5
5,449,854 A * 9/1995 Yap ..... 588/206
5,685,240 A * 11/1997 Briggs, Jr. et al. ..... 110/106
6,196,479 B1 * 3/2001 Edlinger ..... 241/1
6,357,367 B1 * 3/2002 Breen et al. ..... 110/345
6,455,012 B1 * 9/2002 Walker ..... 422/182

* cited by examiner

*Primary Examiner*—Denise L. Esquivel
*Assistant Examiner*—K. B. Rinehart
(74) *Attorney, Agent, or Firm*—Oliff & Berridge, PLC

(57) ABSTRACT

A method for making harmless a material to be treated containing a pollutant, including the steps of arranging a pair of ejecting nozzles such that nozzle openings thereof are opposed to each other inside a pressure-proof furnace, thermally treating that material, ejecting the thermally treated material through each of the nozzle openings of the nozzles, respectively, and colliding the material ejected through one of the nozzles with that ejected through the other in a space inside the pressure-proof furnace and between a pair of the nozzle openings such that a portion of the pollutant of the material remaining non-decomposed by the thermal treatment may be decomposed.

12 Claims, 8 Drawing Sheets

LIQUID MIXER

SOLID MIXER

METHOD AND APPARATUS FOR MAKING A POLLUTANT HARMLESS

BACKGROUND OF THE INVENTION

1. Field of the Invention

The present invention relates to a method and an apparatus for making harmless a pollutant such as exhaust gases, polluted materials such as polluted water, polluted soil, etc.

2. Related Art

Serious social problems have occurred from pollution of the soils with dioxin-containing ashes produced by burning wastes, heavy metal-containing ashes, etc., pollution of rivers, lakes and marshes with waste acids, waste alkali or the like, pollution of underground water with factory waste liquids such as organic chlorine compound-based solvents including trichloroethylene, tetrachloroethylene, etc., pollution of soils with mercury, cadmium, lead, zinc, arsenic, cyan, chromium, copper, fluorides, or organic chlorine compounds, etc. The polluted water has been neutralized, and the polluted soil has been burnt or disposed of for land reclaiming.

However, the land reclaiming is disadvantageous, because it may cause new secondary pollution. There is also available a method by which the polluted soil is melted in a long time and then cracked (vitrified), but the method requires a long treating time and a high treating cost.

SUMMARY OF THE INVENTION

It is an object of the invention to provide a novel method and a novel apparatus for simply and economically treating the polluted materials in a short treating time.

The method for making harmless a material to be treated containing a pollutant, comprises the steps of arranging a pair of ejecting nozzles such that nozzle openings thereof are opposed to each other inside pressure-proof furnace, thermally treating that material, ejecting the thermally treated material through the nozzle opening of each of a pair of the nozzles into a space in the pressure-proof furnace, colliding the material ejected through one of the nozzles with that ejected through the other in the space inside the pressure-proof furnace and between a pair of the nozzle openings such that a portion of the pollutant of the material remaining non-decomposed by the thermal treatment may be decomposed.

The invention also relates to the apparatus utilizing this method or effecting this method.

That is, the apparatus for making harmless a material to be treated containing a pollutant according to the present invention, comprises a thermally treating unit for thermally treating said material, a pressure-proof furnace, a pair of ejecting nozzles arranged such that nozzle openings are opposed to each other inside a space in the pressure-proof furnace, and an ejector for ejecting the thermally treated material into said space through the nozzle openings of each of a pair of the nozzles, whereby the material ejected through one of the nozzles is collided with that ejected through the other in said space inside the pressure-proof furnace and between a pair of the nozzle openings such that a portion of the pollutant of the material remaining non-decomposed by the thermal treatment may be decomposed.

According to the present invention, the pollutant-containing material is first thermally treated to decompose the pollutant, and the material ejected through one of the nozzles is collided with that ejected through the other in the space inside the pressure-proof furnace and between a pair of the nozzle openings such that such pollutant of the material as remaining non-decomposed by the thermal treatment may be substantially decomposed. Thereby, the pollutant is made almost harmless. That is, if the material to be treated is ejected through the nozzle opening and collided with an external plate inside the pressure-proof furnace, the pollutant is decomposed owing to the kinetic energy and the thermal energy of the material ejected through the nozzle. However, considerably high temperature and pressure are required in this method in a case where the pollutant is a stable compound such as dioxin or PCB, for example. According to the present invention, since the materials are ejected through a pair of the opposed nozzles after being first thermally treated, and collided with each other such that such pollutant of the material as remaining non-decomposed by the thermal treatment may be decomposed. As a result, the highly stable compound such as dioxin or PCB can be decomposed by utilizing relatively low temperature and/or pressure.

According to the above nozzle/external plate utilizing method, high temperature and high pressure, for example 650° C. and 300 atms (1 atm=$1.01\times10^{-1}$ MPa), are required to entirely decompose dioxin only by heating under pressurizing. On the other hand, dioxin can be decomposed at far lower temperature and pressure according to the present invention as compared with that method.

For example, the first thermal treatment is effected at 1800° C. to 2000° C., and the temperature decreased from the first thermal treatment stage and the second colliding stage by around 20% of the original temperature, so that the thermally treated material is collided at the decreased temperature, for example under 25 atms (24 MPa) in the pressure-proof furnace. Therefore, when the material ejected through one of the nozzles is collided with that ejected through the other in the space inside the pressure-proof furnace and between a pair of the nozzle openings, the material reaches very high temperature and very high pressure so that such pollutant of the material as remaining non-decomposed by the thermal treatment may be substantially decomposed. The material to be collided may be in the form of a powder, a liquid or the like.

Preferably, a skirt portion is provided for each nozzle such that the each of the skirt portion is communicated with a nozzle opening at one end, and expanded toward the other remote end, and openings of the skirt portions at the other remote ends opposite to the nozzle openings are opposed to each other to sandwich a space therebetween where the materials from the nozzles collide with each other. The skirt portion may be in the form of a conically spread shape as viewed in an ejecting direction. The material to be treated is ejected through the nozzle, restrained with the skirt portion, and led to the colliding space. In this manner, the energy at the collision is remarkably concentratedly increased by the utilization of the skirt portions. The energy usable on collision is confined or concentrated, in a limited area, to a very high level as in the case of an ejection outlet of a rocket by the provision of the skirt portions.

When a gas at a relatively low pressure is flown along the inner peripheral surface of the skirt portion, i.e., between the material ejected through the nozzle opening and the inner peripheral surface of the skirt portion, a so-called curtain can be formed along the inner peripheral surface of the skirt portion to prevent the material from being scattered.

Preferably, a hollow cylindrical member is provided to surround the space where the materials to be treated collide with each other, and the cylindrical member is rotated during when the materials are being collided with each other. By so doing, the cylindrical member functions as a wind shield against shock waves generated on collision, reduces the pressure inside the cylindrical member and minimizes collision influences upon the surrounding area. The pressure at that time can be further reduced by providing a caterpillar inside the cylindrical member.

The material to be treated is preferably thermally treated before being fed to each nozzle. This thermal treatment is particularly efficient in that most of, for example, 90% or more of the pollutant is decomposed and the material is decomposed at almost 100% on collision.

The harmful material is not limited, and may include harmful organic compounds, harmful inorganic compounds and harmful microorganisms (pathogens). As the harmful organic compounds, recitation may be made of organic solvents (particularly chlorine-based organic solvents), organic chlorine compounds such as trichloroethylene, tetrachloroethylene and dioxin, organic bromine compounds, and harmful gases (yperite, sarin, tabun, phosgene, etc.), for example. As the harmful microorganisms, particularly, pathogens of biohazard levels III and IV may be recited. The material to be treated are not limited. The present invention can be applied to any pollutant-containing materials to be treated, excluding metals themselves, in any forms, such as polluted air, polluted soil, tires, plastics, medical wastes, shredder dusts, construction wastes, heavy metal-containing ashes, etc.

According to the present invention, the collision between the materials to be treated decomposes the pollutant in the material and thereby makes the pollutant harmless. Further, when the materials containing the pollutant such as heavy metal are collided with each other, the material is solidified into a slag or glassy sold matter. Thereby, the pollutant can be made harmless through being enclosed in the thus formed solid.

These and other objects, features and advantages of the invention will be appreciated upon reading the following description of the invention when taken in conjunction with the attached drawings, with the understanding that some modifications, variations and changes could be easily made by the skilled person in the art to which the invention pertains.

BRIEF DESCRIPTION OF THE INVENTION

For a better understanding of the invention, reference is made to the attached drawings, wherein.

Figure 5A:
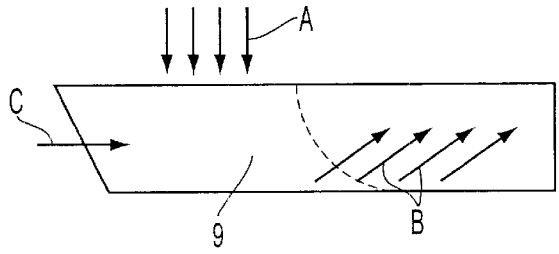
FIG. 5(*a*) is a sectional view of each flow passage.
Figure 5B:
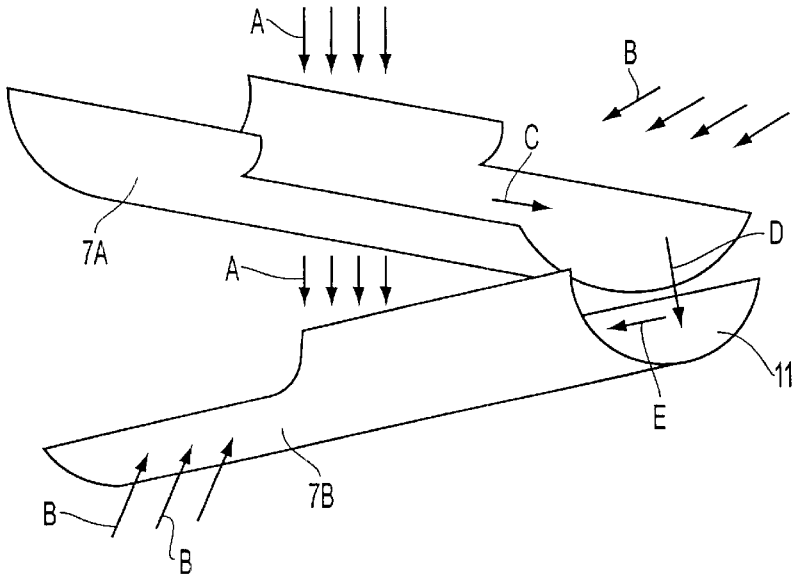
Figure 5C:
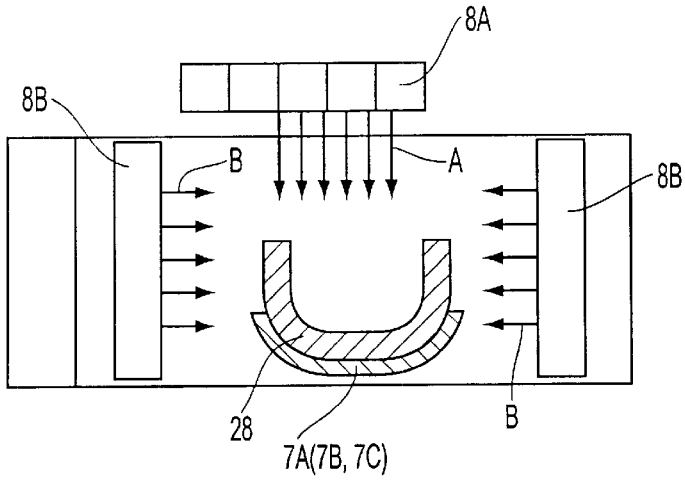
Figure 6:
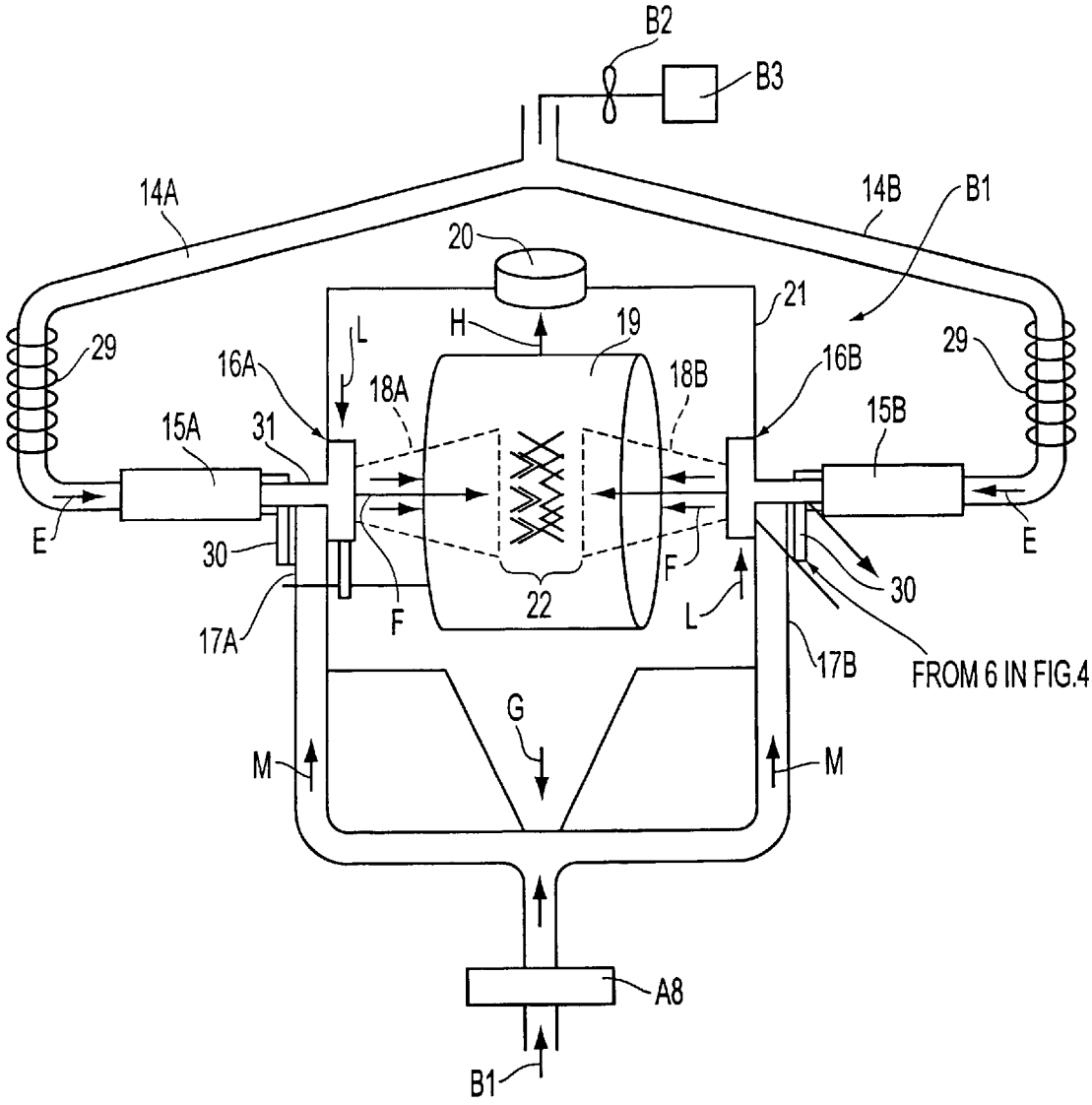
Figure 7:
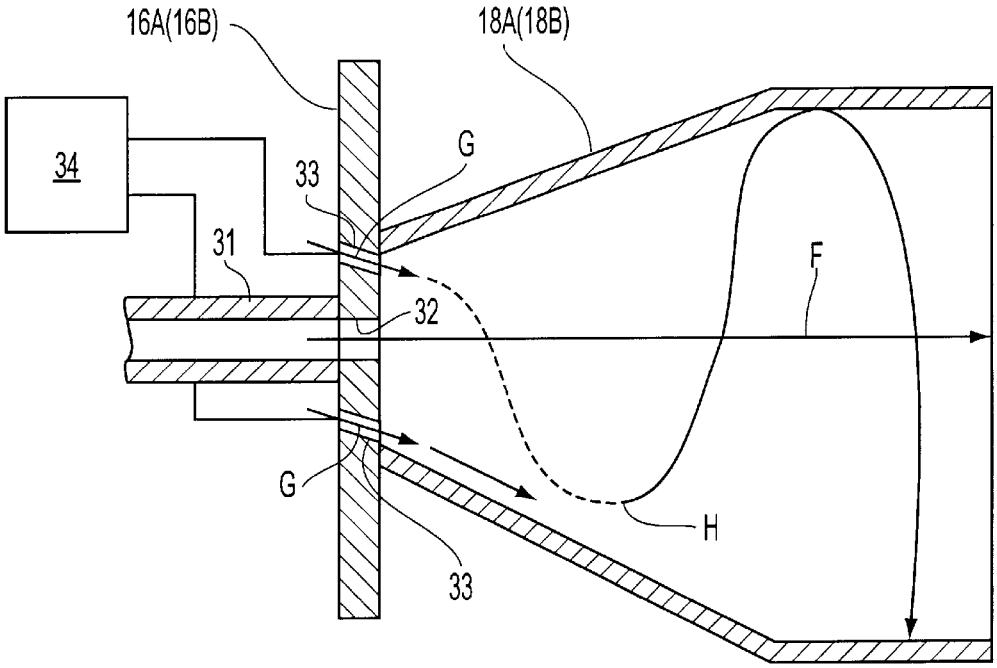
Figure 8:
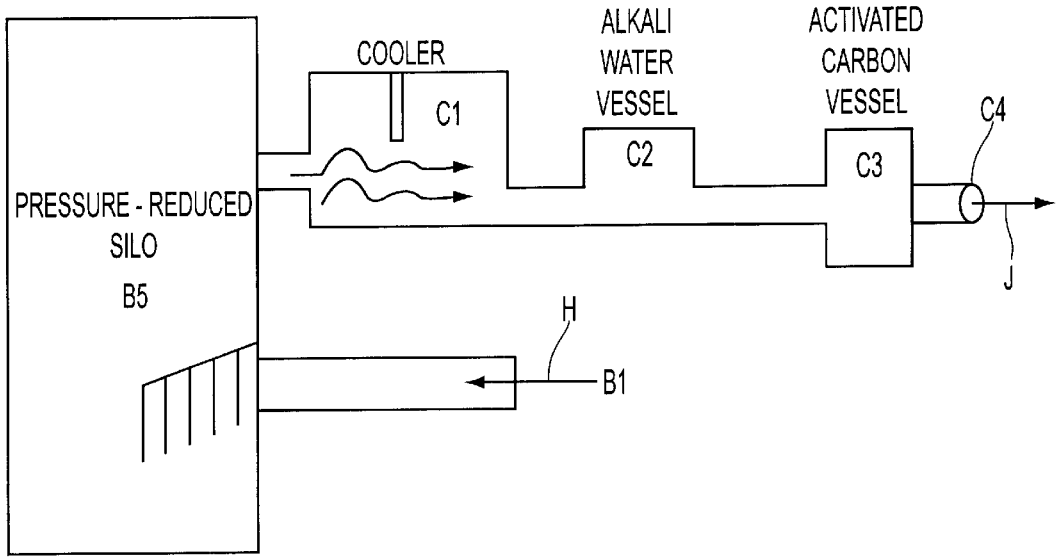

FIG. 5(*b*) being a perspective view showing flow passages 7A and 7B, and FIG. 5(*c*) being a schematic view showing the positional relationship between the flow passages and burners;

FIG. 6 is a schematic view showing a collision treating apparatus B1 according to a preferred embodiment of the present invention;

FIG. 7 is a sectional view schematically showing a portion around a nozzle opening for ejecting a material to be treated; and FIG. 8 is a block diagram showing a final stage for the treatment of exhaust gases in the preferred embodiment of the present invention.

DETAILED DESCRIPTION OF THE INVENTION

Figure 1:
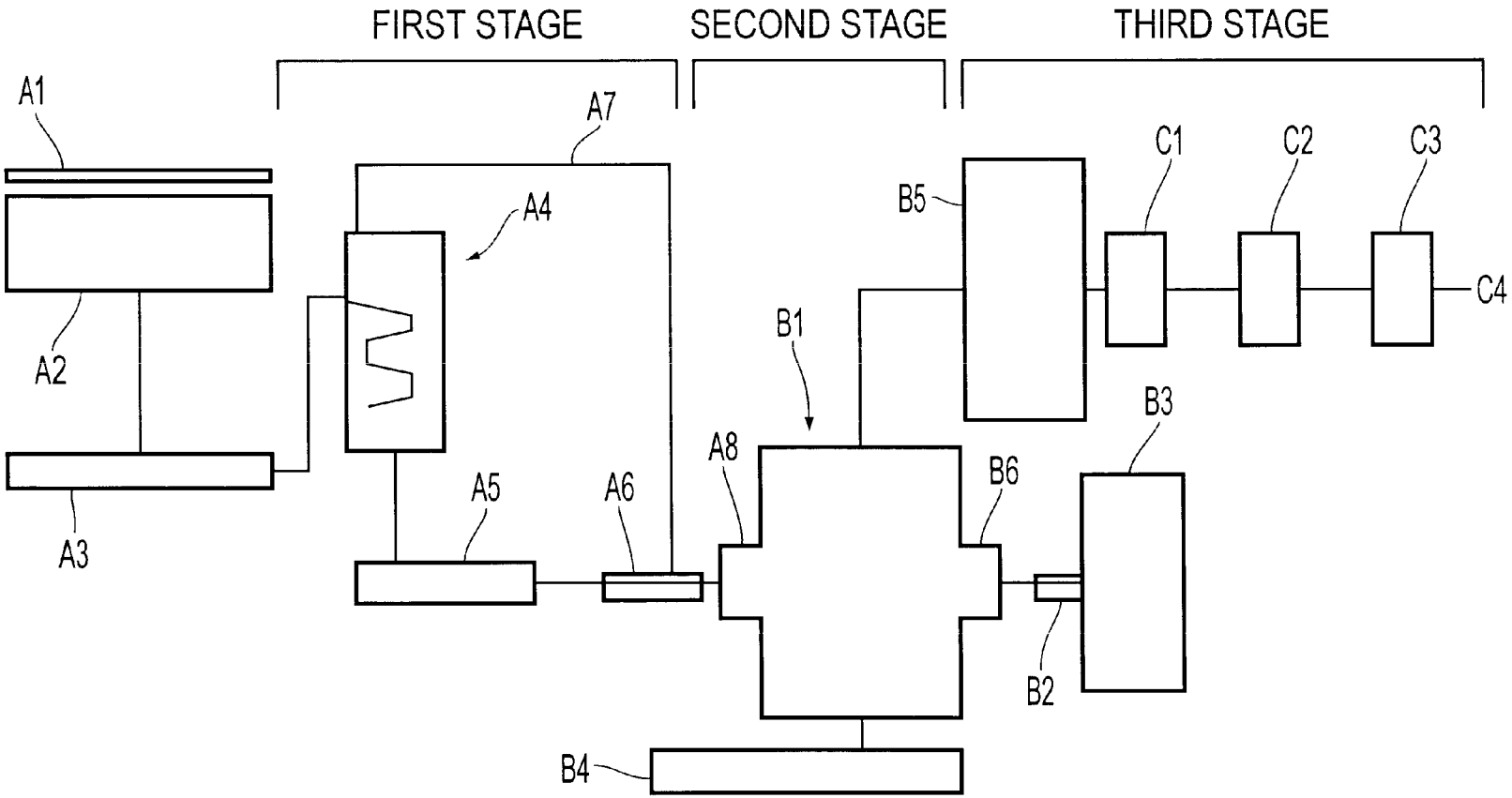
FIG. 1 is a block diagram showing an apparatus according to a preferred embodiment of the present invention.
Figure 2:
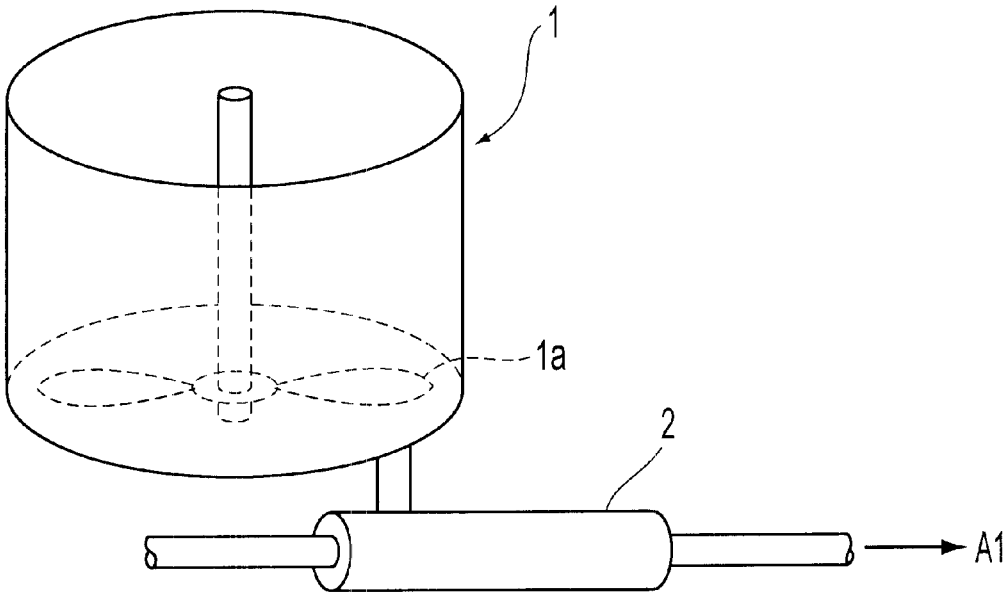
FIG. 2 is a schematic view showing a liquid.

FIGS. 1 to 8 illustrate preferred embodiments of the present invention. In FIG. 1, a pretreatment is effected in A1 to A3, and a first stage heating treatment is effected in A4, a second stage collision treatment is effected in B1, and a post treatment is effected in a third stage.

Figure 3:
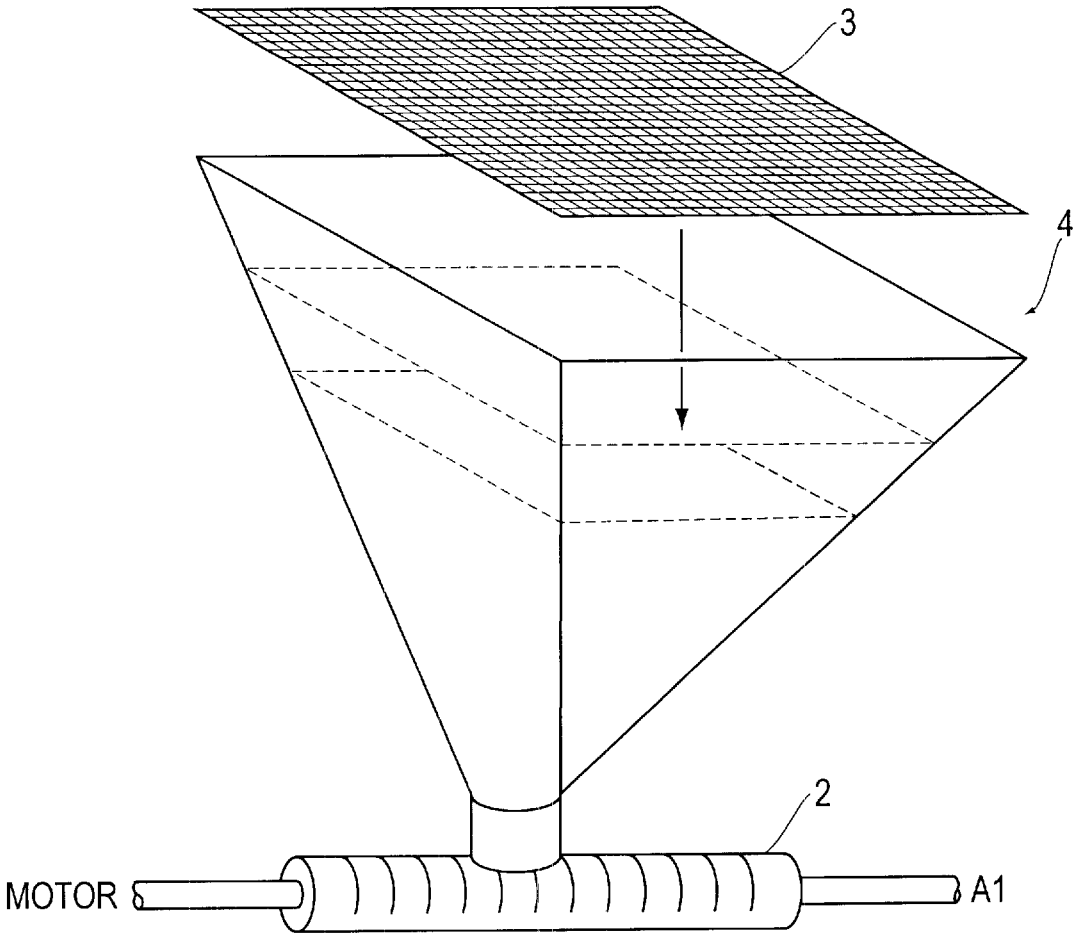
FIG. 3 is a schematic view showing a solid mixer.

In the following, a case where a polluted soil or polluted water is treated will be explained as a typical example. In the case of polluted water, the water is fed to a liquid mixer 1 in FIG. 2 where the water is stirred with vanes 1*a,* and then led to a screening net A1 in FIG. 1 by means of a screw pressure feeder 2. In the case of the polluted soil, as shown in FIG. 3, the soil is fed into a solid mixer 4 through a vibration net 3, and led to the screening net A1 by a screw pressure feeder 2. As shown in FIG. 1, the material to be treated is passed through the screening net A1 to remove pebbles and the like, and stored in a decomposition/collection stocker A2. Then, the material is led to a heat treating unit A4 by means of a screw pressure feeder A3.

Figure 4:
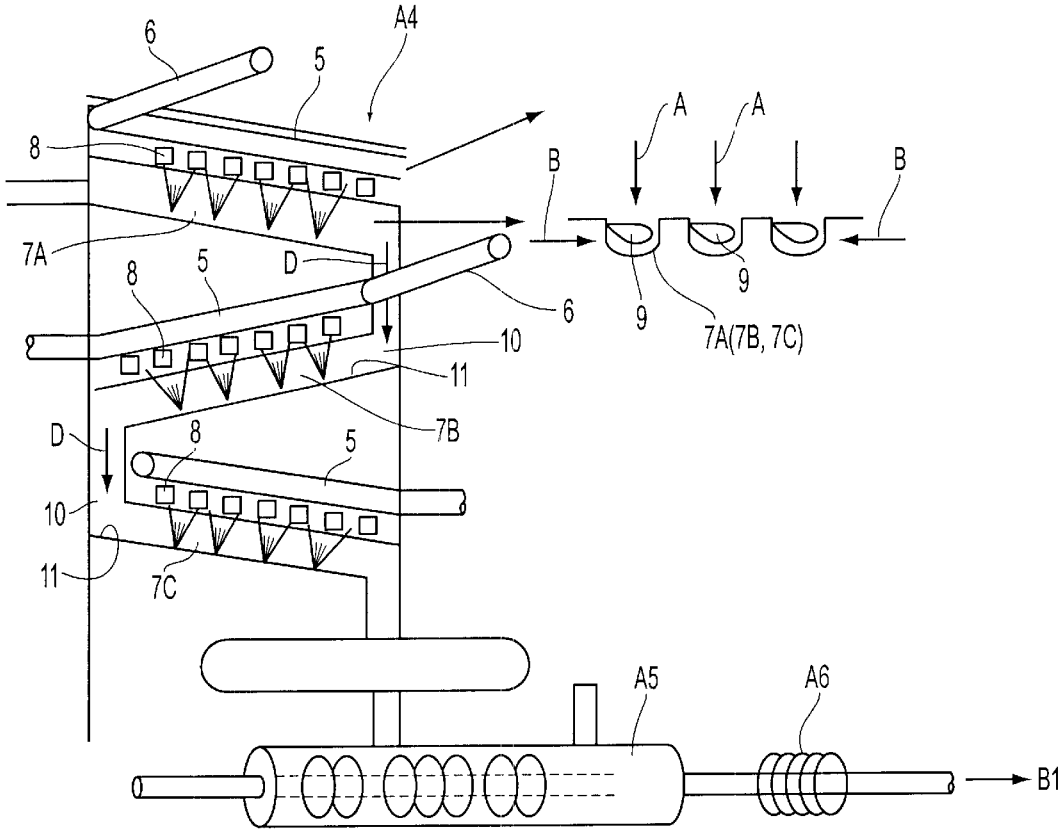
FIG. 4 is a schematic view showing the structure of a heating apparatus A4.

FIG. 4 is a schematic view of the heat treating unit A4, and FIG. 5(*a*) is a sectional view of each flow passage, FIG. 5(*b*) being a perspective view showing flow passages 7A and 7B, and FIG. 5(*c*) being a schematic view showing the positional relationship between the flow passages and burners. The material 9 to be treated enters the flow passage 7A, comes out through an outlet of the flow passage 7A, drops through a vertically dropping zone 10_and impinges upon a wall face 11 of a downstream flow passage 7B. Then, the material changes its flow direction, flows through the flow passage 7B, comes out through its outlet, drops through a vertically dropping zone 10, impinges upon a wall face 11 of a downstream flow passage 7C, and enters the flow passage 7C after changing its flow direction. After the material comes out from the flow passage 7C, it is led to a collision treating unit B1 through a screw pressure feeder A5. A6 is a heater for preventing the solidification of the material to be treated.

As shown in FIGS. 5(*a*) to 5(*c*), each flow passage is in the form of a trough. The material 9 to be treated flows in the flow passage in an arrow direction C. Heat is applied to the material in each flow passage 7A, 7B, 7C first from the upper side as in an arrow direction A through burners 8A, and then from opposite sides as in arrow directions B, B through burners 8B. As a result, while the material to be treated flows through each flow passage, it is heat treated from the upper side and the lateral sides. The material reaches high temperatures except a portion near bottom faces of the flow passages, which advances the heat treatment.

A secondary harmful material may be produced in the heating furnace through burning of the material to be treated. For example, if the material to be treated contains an organic chlorine compound such as PCB, dioxin comes out as the temperature rises. Such a gaseous harmful material is collected in flow channels 5, and led outside from the furnace through conduits 6, and finally to conduits 3 in FIG. 6 as mentioned later.

Then, as shown in FIG. 5(*b*), the material to be treated drops through the outlet of the flow passage as shown in an arrow direction D, impinges upon the wall surface 11, and then flows in a direction E opposite to that in the immediately upstream flow passage. The material to be treated falls up-and-down. That is, a portion (that is, a low-temperature portion) of the material on the bottom face of the flow passage 7A at its outlet is exposed upwardly after the falling. Thereafter, this portion is heated in the flow passage 7B from the upper side as shown by the arrows A. Therefore, that portion (that is, the low-temperature portion) of the material which has been located on the bottom face of the flow passage 7A at its outlet is directly heated with flames from the burners in the flow passage 7B. Repetition of this process thoroughly and uniformly heat treats the entire material to be treated. After the heat treatment, the material to be treated is led to the collision treating unit B1 by means of a screw pressure feeder A5.

As mentioned above, it is preferable that in the heat treatment, at least two flow passages are provided for flowing down the material therein, the dropping zone for the material to be treated is provided between the outlet of the upstream flow passage and the inlet of the downstream flow passage between the vertically adjacent flow passages, and the material-flowing direction in the upstream flow passage is opposite to that in the downstream flow passage, when the passages are viewed from the upper side.

Preferably, the upper and lower flow passages are reversed as viewed from the upper side (arranged in opposite directions), which readily and uniformly heat treats the entire material to be treated.

Although the number of the burners is not limited, 15 to 20 upper burners 8A and 15 to 20 side burners at each side may be provided for each flow passage, for example (See FIG. 5(*c*)). The gas flow passages of the burners may be particularly preferably made of a heat-resistant material capable of withstanding 2000° C., but an ordinary heat-resistant material may be used. As a fuel for the burners, propane gas (1300 to 1500° C.), acetylene gas (1500 to 2000° C.), etc. may be recited. When the material to be treated passes through the flow passage, the heat may be applied from upper side for 3 to 15 seconds, for example (preferably not more than 10 seconds), whereas heat is applied from the opposite sides for 3 to 15 seconds, for example (preferably not more than 10 seconds). Most organic pollutants can be decomposed (1750° C. PCB and 1350° C. for dioxin).

The inclination angle of the flow passage to the horizontal plane is not particularly limited, so long as the material to be treated readily flows and drops at appropriate speeds, but the inclination angle is preferably 10° to 30°. The thickness of the material flowing in and dropping from the flow passage is preferably 10 to 15 mm. If the material to be treated is liquid, it is preferable to dilute the concentration of the pollutant and scramble it.

The exhaust gases generated in the heat treating unit A4 passes through the exhaust gas channel A7 in FIG. 1, and fed to a distributor A5 in the sate that the waste gas is mixed with the material heat treated. As shown in FIG. 6, the material to be treated is fed in an equal amount to flow passages 17A, 17B through the distributor A8 as shown by arrows M, M. The harmful material discharged outside of the furnace through the conduits 6 in FIG. 4 enters the conduits 30 in FIG. 6, and mixed with the material to be treated, and the mixture is fed to the nozzle members 16A, 16B.

The compressed gas is fed in an equal amount to ejecting units 15A, 15B from a compressor B3 through a value B2 and compressed gas flow passages 14A, 14B as in arrows E, E. At that time, each of the flow passages 14A, 14B is surrounded with a coil heater 29, so that the gas flowing inside the flow passages 14A, 14B is heated and the pressure thereof is further raised. The material fed from the flow passage 17A, 17B joins the compressed gas, and the mixture is ejected through a nozzle opening at a tip of a nozzle member 16A, 16B.

A outwardly expanded skirt portion 18A, 18B is attached to a tip end of each nozzle, and a tip end openings of the skirt portions are opposed to each other. Therefore, the materials are ejected through the respective openings of the nozzles, while their flows are confined with the respective skirt portions as shown by arrows F. Then, the materials vigorously collide with each other at a colliding zone 22. This collision decomposes the pollutant still remaining in the material even after the heat treatment.

In this embodiment, the tip end areas of the skirt portions and the collision zone 22 are surrounded with a cylindrical member 19. When the materials collide with each other, the cylindrical member 19 is rotated by a motor or the like (not shown) to function as a wind shield for preventing the material from being scattered, while the inside of the cylindrical member 19 is reduced in pressure. The cylindrical member 19 may be provided with stabilizing blades at an inner periphery thereof for mitigating the impact of the materials radially outwardly scattering on collision. The exhaust gas produced on collision rises as shown by an arrow H, and enters an exhaust gas purifying system through an exhaust opening 20. The solid material produced after the collision falls as shown by an arrow G, and taken out through a decomposed solid discharge unit (slag discharge opening) B4 shown in FIG. 1. Heat shield is effected by obliquely blowing out cold air as shown by arrows L to enclose the thermally treated material ejected.

The above-mentioned face-to-face collision of the materials tremendously increases the decomposing energy to be applied to the materials. For example, assuming that the diameter of the compressed gas nozzle is 15 mm, the nozzle diameter of the material to be treated is 30 mm, and the pressure of the compressed air to the nozzle is 50 atms, the power on collision reaches a level of 250 atms, which is sufficient for decomposing the organic pollutants and the inorganic pollutants at molecular levels. The ejecting pressure of each nozzle is preferably not less than 50 atms. The larger the ejecting pressure, the more the amount of the material capable of being treated. From the standpoint of the safety of the apparatus, the ejecting pressure of each nozzle is more preferably not greater than 30 atms.

FIG. 7 shows a schematically enlarged view of an area around the opening of the nozzle member. A nozzle opening 32 is provided, for example, in a central portion of the nozzle member 16A (or 16B), and the material to be treated, which flows through the-flow passage 31, is ejected through the nozzle opening 32 as shown by an arrow F. Near and radially inwardly from a root of the skirt portion 18A (18B) is formed a nozzle opening 33 for cold gas. Preferably, plural such cold gas nozzle openings 33 are provided near the root of the skirt portion. The nozzle opening 33 preferably extends inclinedly to the nozzle opening 32 so that the cold gas may be ejected obliquely to the material to be treated as shown by an arrow G. The nozzle opening 33 is connected to a cold gas feeder 34. The cold gas ejected through the nozzle opening 33 flows in a direction inclined to the center line of the nozzle 32 as shown by the arrow G, collides with the inner peripheral surface of the skirt portion 18A, 18B, and swirls as shown by an arrow H. As a result, the cold gas functions as a kind of air curtain to shield the high-temperature material from the inner peripheral face of the skirt portion.

The cold gas means a gas at sufficiently lower temperature as compared with the material to be treated, and typically a gas at room temperature to not more than 100° C. The ejecting pressure of the cold gas is preferably 2 to 20 atms and more preferably around 10 atms.

As shown in FIG. 8, the exhaust gases produced on collision enters a pressure-reduced silo (pressure-dispersing silo) B5 as shown by an arrow H, passes through a cooler C1, an alkaline water vessel C2, and an activated carbon vessel C3, and is discharged through a discharge opening 4 as shown by an arrow J.

In a typical example, it is ideal that the angle of the stabilizer blade is 10°, the rotating speed of the cylindrical member 19 is 4 rpm, the pressure of the cold gas-blowing nozzle 33 is 10 atms, the diameter of the nozzle for blowing the material to be treated is 40 mm, the length of the skirt portion is 400 mm, the diameter of the tip end side of the skirt portion is 200 mm, and the width of the collision zone is 100 mm.

The treating apparatus thus constructed can be carried by using two 12-ton trucks. The harmless treating power is as much as tons/day for solids and as much as 36 tons/day for liquids. 99.9999% of the harmful organic compound is decomposable.

According to the present invention, the novel method and novel apparatus for conveniently and readily treating the materials shorter time can be provided.

What is claimed is:

1. A method for making harmless a material to be treated containing a pollutant, comprising the steps of arranging a pair of ejecting nozzles such that nozzle openings thereof are opposed to each other inside a pressure-proof furnace, thermally treating said material, ejecting the thermally treated material to each of a pair of said nozzles, ejecting the material into the pressure-proof furnace through each of the nozzle openings of the nozzles, respectively, and colliding the material ejected through one of the nozzles with that ejected through the other in a space inside the pressure-proof furnace and between a pair of the nozzle openings such that a portion of the pollutant of the material remaining non-decomposed by the thermal treatment may be decomposed.

2. The method set forth in claim 1, wherein the material is ejected through each of the nozzle openings of the nozzles together with a compressed gas.

3. The method set forth in claim 1, wherein the material ejected through each of the nozzle openings is spatially confined in a conically spread form as viewed from an ejecting direction before the collision.

4. The method set forth in claim 1, wherein the materials are prevented from scattering radially outwardly out of said space.

5. The method set forth in claim 1, wherein the material flowing in the treatment is turned up-and-down.

6. The method set forth in claim 1, wherein an exhaust gas coming out from the thermal treatment of said material is ejected into said space together with said material.

7. An apparatus for making harmless a material to be treated containing a pollutant, comprising:

a thermally treating unit for thermally treating said material;

a pressure-proof furnace;

a pair of ejecting nozzles arranged such that nozzle openings are opposed to each other inside a space in the pressure-proof furnace; and an ejector for ejecting the thermally treated material into said space through the nozzle openings of each of a pair of the nozzles, whereby the material ejected through one of the nozzles is collided with that ejected through the other in said space inside the pressure-proof furnace and between a pair of the nozzle openings such that a portion of the pollutant of the material remaining non-decomposed by the thermal treatment may be decomposed, wherein said nozzles are provided, around openings of the nozzles, respectively, with outwardly expanded skirt portions, and openings at tip ends of the skirt portions are opposed to each other through said space where the materials ejected collide with each other.

8. The apparatus set forth in claim 7, wherein said ejector comprises a gas compressor for ejecting the thermally treated material into said space through the nozzle openings of each of a pair of the nozzles.

9. The apparatus set forth in claim 7, which further comprises a cylindrical member surrounding the space, from a radially outer side, where the materials from the opposed respective nozzle openings collide with each other, said cylindrical member being rotated while the materials are collided with each other.

10. The apparatus set forth in claim 7, wherein the thermally treating unit comprises at least two flow passages through which the material flows down, and a dropping zone for the material to be treated, said dropping zone being provided between an outlet of an upstream flow passage and an inlet of an downstream flow passage in vertically adjacent flow passages, and a material-flowing direction in the upstream flow passage being opposite to that in the downstream flow passage, when the passages are viewed from an upper side.

11. The apparatus set forth in claim 7, wherein a gas generated in said thermally treating unit is ejected into said space through the nozzle openings together with the material to be treated.

12. The apparatus set forth in claim 7, wherein a gas is fed along the skirt portions to form a shield gas curtain to shield inner peripheral faces of the skirt portions from streams of the materials through the nozzles.

* * * * *